US007625245B1

(12) United States Patent
Yao

(10) Patent No.: US 7,625,245 B1
(45) Date of Patent: Dec. 1, 2009

(54) LOW-PROFILE ELECTRICAL CONNECTOR AND DEVICE THEREOF

(75) Inventor: Guilin Yao, Hunan (CN)

(73) Assignee: Lotes Co., Ltd., Keelung (TW)

( * ) Notice: Subject to any disclaimer, the term of this patent is extended or adjusted under 35 U.S.C. 154(b) by 2 days.

(21) Appl. No.: 12/219,560

(22) Filed: Jul. 24, 2008

(51) Int. Cl.
*H01R 33/00* (2006.01)

(52) U.S. Cl. ..... 439/660; 439/607.4

(58) Field of Classification Search ..... 439/660, 439/607, 668, 669, 79
See application file for complete search history.

(56) References Cited

U.S. PATENT DOCUMENTS 4,425,015 A * 1/1984 Rizzo ..... 439/83
5,266,038 A * 11/1993 Nakamura ..... 439/79
6,439,931 B1 * 8/2002 Niitsu et al. ..... 439/660
2006/0079130 A1 * 4/2006 Zhang et al. ..... 439/607

* cited by examiner

*Primary Examiner*—Neil Abrams
*Assistant Examiner*—Phuong Nguyen
(74) *Attorney, Agent, or Firm*—Rosenberg, Klein & Lee

(57) ABSTRACT

A low-profile electrical connector mounted on a circuit board includes an insulating body. The insulating body includes a main body portion, a middle portion and a tongue plate. The main body portion has a slot concavely formed in a front end thereof, and at least one sidewall of the slot has a plurality of first terminal receiving grooves formed at intervals therein. The middle portion is formed by a bottom surface of the main body portion partially extending downwards. The tongue plate extends forwards from the middle portion and has a plurality of second terminal receiving grooves formed at intervals therein. A plurality of conductive terminals are respectively correspondingly received in the terminal receiving grooves. Comparing with conventional low-profile electrical connectors, the present invention can not only engage with various butting assemblies, but also save internal space of computers.

17 Claims, 10 Drawing Sheets

LOW-PROFILE ELECTRICAL CONNECTOR AND DEVICE THEREOF

BACKGROUND OF THE INVENTION

1. Field of the Invention

The present invention relates to an electrical connector, and more especially to a low-profile electrical connector and device thereof.

2. Description of Related Art

With the development of science and technology and people's living standards, computers become an important part of people's lives. Especially, notebook computers are widely used in people's lives because of their portability. For meeting the increasing requirements of people for notebook computers, notebook computers must be smaller, lighter and thinner, which requires that electrical connectors which are important components of notebook computers occupy the smallest space without affecting normal electrical connection.

Conventional electrical connectors are directly connected to circuit boards. However, the electrical connectors occupy much space themselves, which does not meet the development of computers. With the development of computer technology, low-profile electrical connectors come out. The low-profile electrical connectors can be partially inserted into holes in circuit boards to reduce the height of exposed portions of the low-profile electrical connectors above the circuit boards, thereby making the most of space inside computers. However, the conventional low-profile electrical connectors are limited in their structures so that they cannot engage with various butting assemblies.

Accordingly, there is a need for improving conventional low-profile electrical connectors to design a new electrical connector.

SUMMARY OF THE INVENTION

An object of the present invention is to provide a low-profile electrical connector which can not only engage with various butting assemblies, but also save internal space of computers.

To achieving the above-mentioned object, a low-profile electrical connector in accordance with the present invention is provided. The low-profile electrical connector mounted on a circuit board includes: an insulating body which includes a main body portion having a slot concavely formed in a front end thereof, wherein the slot faces inside and at least one sidewall of the slot has a plurality of first terminal receiving grooves formed at intervals therein; a middle portion formed by a bottom surface of the main body portion partially extending downwards; and a tongue plate which extends forwards from the middle portion and has a plurality of second terminal receiving grooves formed at intervals therein; and a plurality of conductive terminals respectively correspondingly received in the terminal receiving grooves.

To achieve the above-mentioned object, the present invention further provides a low-profile electrical connector. The low-profile electrical connector includes an insulating body which includes a main body portion having a slot concavely formed in a front end thereof and a through-groove concavely formed in a rear end face of a bottom thereof, wherein at least one sidewall of the slot has a plurality of first terminal receiving grooves formed at intervals therein; a middle portion formed by a bottom surface of the main body portion partially extending downwards; and a tongue plate which extends forwards from the middle portion and has a plurality of second terminal receiving grooves formed at intervals in a top surface of the tongue plate, wherein the top surface of the tongue plate is lower than a top surface of the through-groove in a vertical direction; a plurality of first conductive terminals respectively correspondingly received in the first terminal receiving grooves; and a plurality of second conductive terminals respectively correspondingly received in the second terminal receiving grooves.

Another object of the present invention is to provide a low-profile electrical connector device which ensures that the low-profile electrical connector can not only engage with various butting assemblies, but also save internal space of computers.

To achieve the above-mentioned object, a low-profile electrical connector device in accordance with the present invention is provided. The low-profile electrical connector device includes a circuit board having a cutout; and a low-profile electrical connector which includes an insulating body including a main body portion which has a slot concavely formed in a side thereof, at least one sidewall of the slot having a plurality of first terminal receiving grooves formed at intervals therein; a middle portion formed by a bottom surface of the main body portion partially extending downwards, wherein the middle portion includes a first middle portion and a second middle portion located below the first middle portion, and a rear end face of the second middle portion and a bottom surface of the first middle portion define a space and the circuit board is partially received in the space; and a tongue plate which extends forwards from the middle portion and has a plurality of second terminal receiving grooves formed at intervals therein, wherein the tongue plate is received in the cutout; and a plurality of conductive terminals respectively correspondingly received in the terminal receiving grooves.

Since the slot has the plurality of first terminal receiving grooves formed at intervals in one sidewall thereof and the tongue plate has the second terminal receiving grooves formed in the top surface thereof, the first terminal receiving grooves and the second terminal receiving grooves lie in different planes, so that the low-profile electrical connector can engage with various butting assemblies. Furthermore, when the low-profile electrical connector is mounted on the circuit board, a part of the connector is located below the circuit board, so the height of the exposed portion of the low-profile electrical connector above the circuit board is reduced, thereby saving the circuit board space.

DETAILED DESCRIPTION OF THE PREFERRED EMBODIMENTS

To further understand features and technical contents of the present invention, please refer to the drawings and the following detailed description related the low-profile electrical connector according to the present invention.

Figure 1:
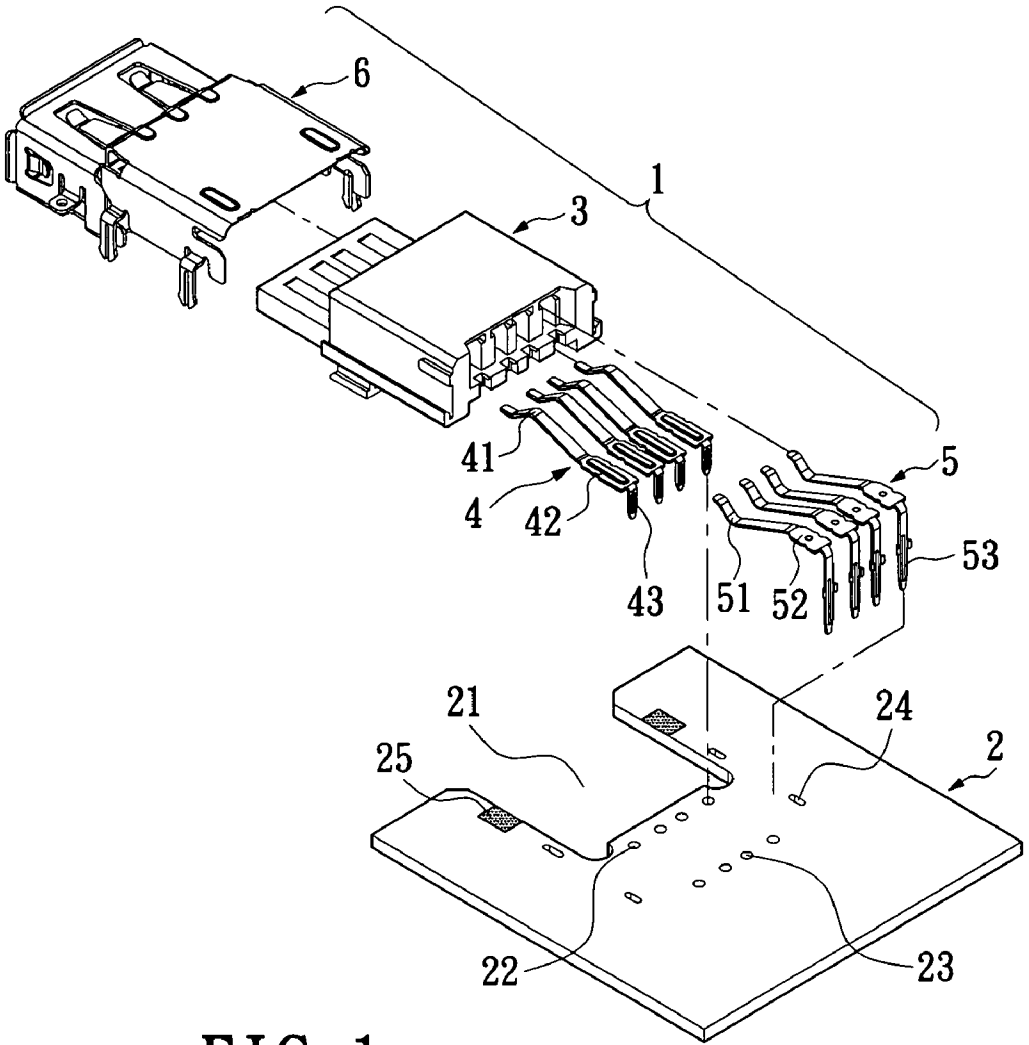
FIG. 1 is an exploded perspective schematic view of a low-profile electrical connector according to the present invention and a circuit board.
Figure 2:
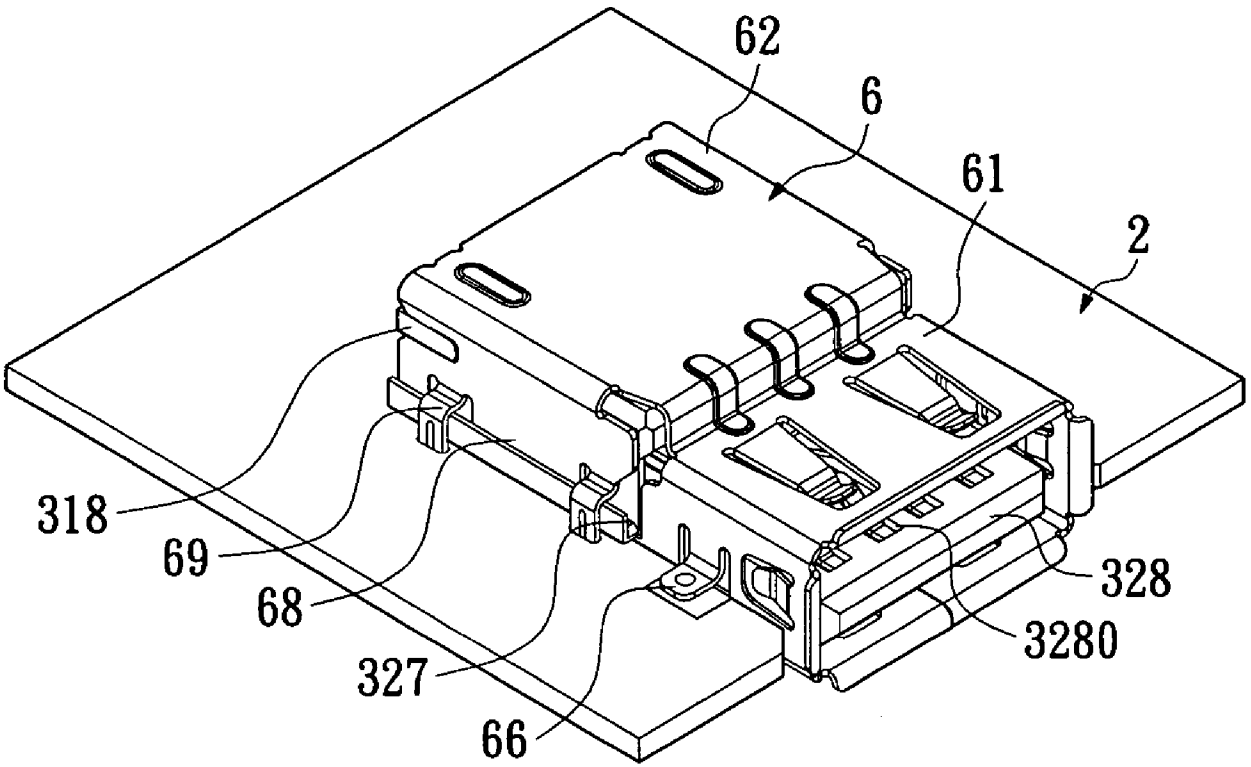
FIG. 2 is an assembled perspective schematic view of the low-profile electrical connector according to the present invention and the circuit board.

Please refer to FIG. 1 and FIG. 2, a low-profile electrical connector 1 of the present invention is mounted on a circuit board 2. The circuit board 2 has a cutout 21 formed in one end thereof, a plurality of second terminal welding holes 22 and a plurality of first terminal welding holes 23 formed in the circuit board 2 behind the cutout 21, and a plurality of pin holes 24 and two welding pads 25 respectively located on the two sides of the cutout 21, wherein the welding pads 25 are closer to the front end of the cutout 21 than the pin holes 24.

The low-profile electrical connector 1 includes an insulating body 3, a plurality of first conductive terminals 5 and a plurality of second conductive terminals 4 held in the insulating body 3, and a metal housing 6 covering the insulating body 3.

Please refer to FIGS. 3-5, FIG. 8 and FIG. 11, the insulating body 3 is integrally made of insulating material. Seen from the side, the insulating body 3 is step-shaped. The insulating body 3 includes a main body portion 31, a middle portion 32 and a tongue plate 328.

The main body portion 31 has a front end face 311, left and right lateral faces 315 and a bottom surface 317. The bottom surface 317 of the main body portion 31 partially extends downwards to form the middle portion 32. The bottom surface 317 of the main body portion 31 has a hollow-out portion 319 formed near the center thereof. A slot 314 is inward concavely formed in the front end face 311 of the main body portion 31 and connected with the hollow-out portion 319. The slot 314 has an upper sidewall 3140 and a lower sidewall, wherein the upper sidewall 3140 has a plurality of first terminal receiving grooves formed at intervals therein for receiving the first conductive terminals 5 and the lower sidewall has two fool-proof units 310 respectively extending upwards from two sides thereof. The main body portion 31 has locking blocks 318 respectively protruding from the two lateral faces 315 thereof for engaging with the metal housing 6.

The middle portion 32 includes a first middle portion 325 and a second middle portion 326. The first middle portion 325 has a first front end face 321 and a first bottom surface 324. The second middle portion 326 has a second front end face 322 and a second bottom surface 334.

Figure 4:
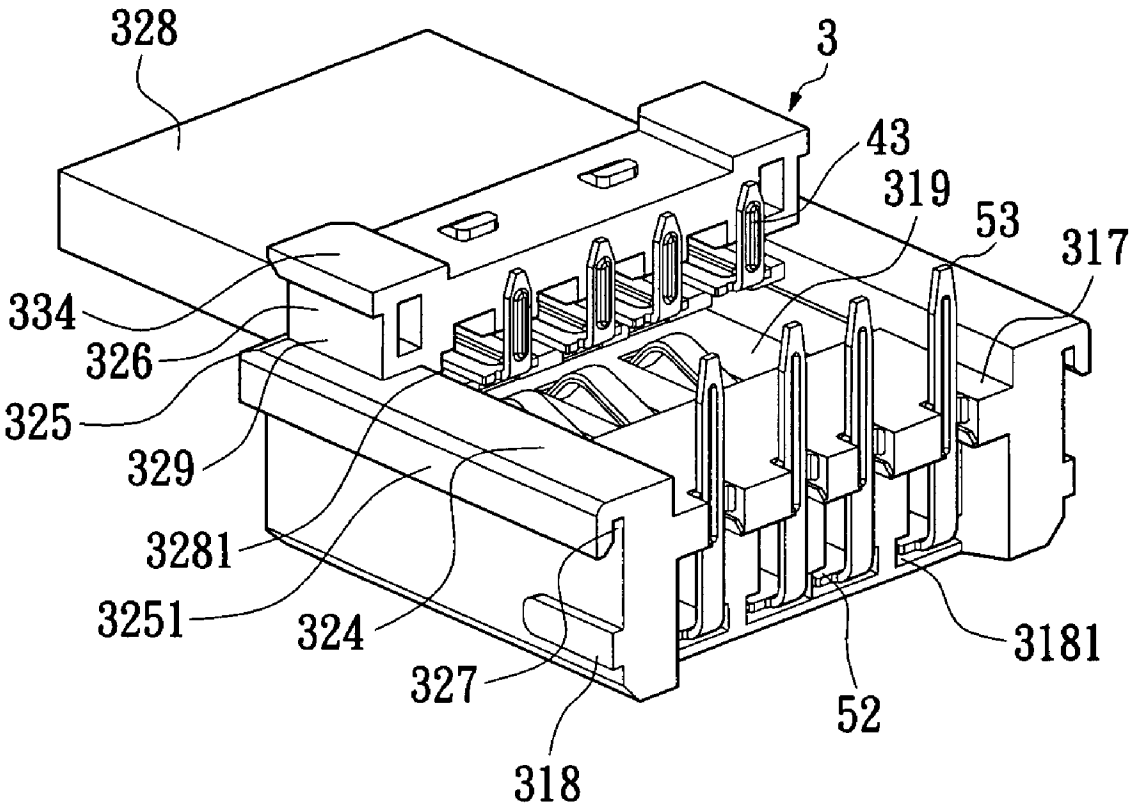
FIG. 4 is an assembled perspective schematic view of the insulating body and the conductive terminals of the low-profile electrical connector according to the present invention, from another angle.

The tongue plate 328 is formed by extending the first front end face 321 and the second front end face 322 forwards. The tongue plate 328 has a plurality of second receiving portions 3280 formed on the top surface thereof, which extends towards the middle portion 32 to form a plurality of second holding grooves 3281 (as shown in FIG. 4). The second holding grooves 3281 extend rearwards through the middle portion 32 and are connected with the hollow-out portion 319 and the slot 314. Additionally, a second receiving groove is defined herein to include the second receiving portions 3280 and the second holding grooves 3281.

Figure 8:
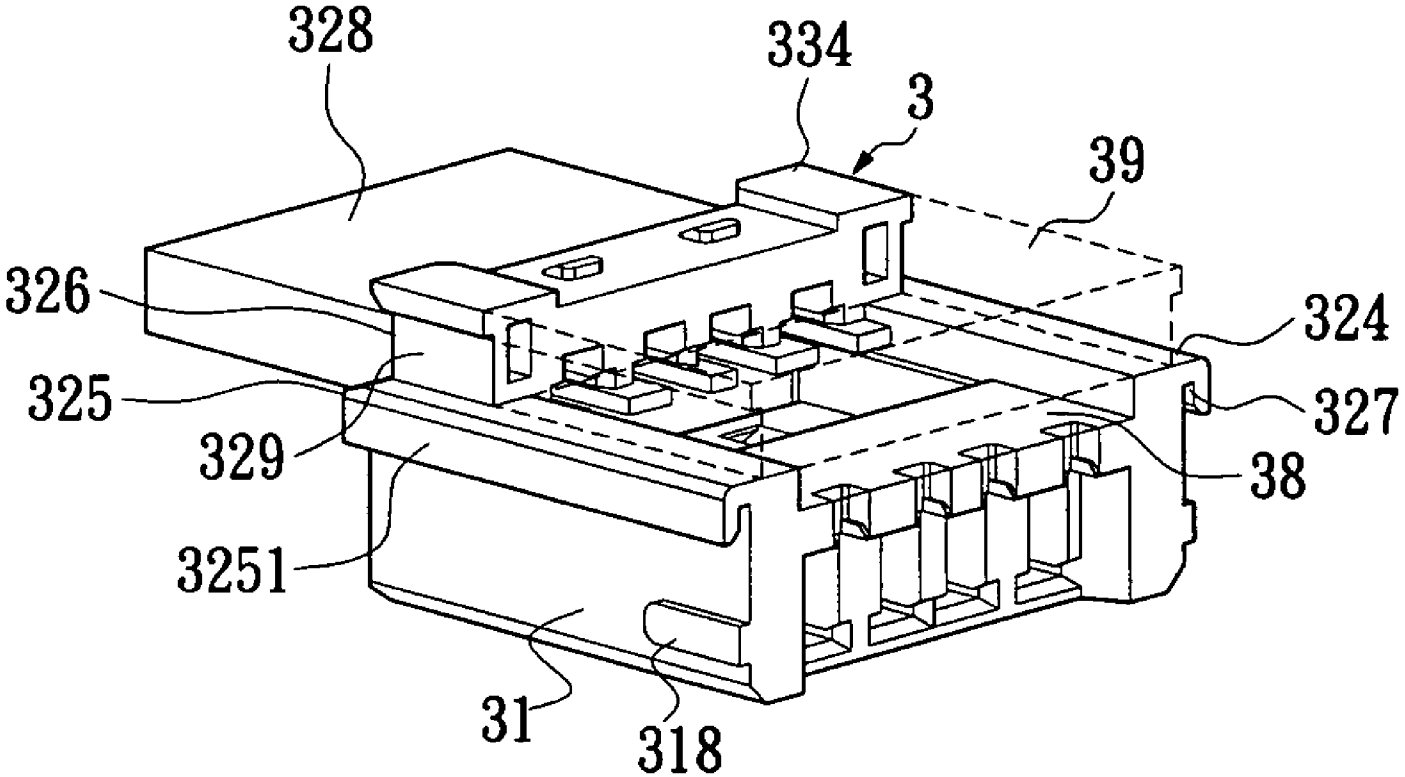
FIG. 8 is a perspective schematic view of the insulating body in FIG. 4.

A through-groove 38 (as shown in FIG. 8) is formed between the first bottom surface 324 of the middle portion 32 and the bottom surface 317 of the main body portion 31. The through-groove 38 is connected with the hollow-out portion 319 and the slot 314, thereby the second conductive terminals are conveniently mounted in the second receiving portions 3280 of the tongue plate 328 and the second holding grooves 3281 of the middle portion 32.

Please refer to FIG. 8, there is a drop from the first bottom surface 324 of the middle portion 32 to the second bottom surface 334, so a space 39 is formed between the first bottom surface 324 and the second bottom surface 334. The circuit board 2 is partially disposed in the space 39, and the first bottom surface 324 abuts against the circuit board 2 and the second bottom surface 334 is located below the circuit board 2.

Two protruding blocks 3251 respectively protrude outward from two sides of the first middle portion 325. Each protruding block 3251 has a sliding groove 327 formed therein. Also, two fastening grooves 329 are respectively formed in two sides of the second middle portion 326. The upper walls of the fastening grooves 329 are adjacent to the first bottom surface 324 of the first middle portion 325.

Figure 5:
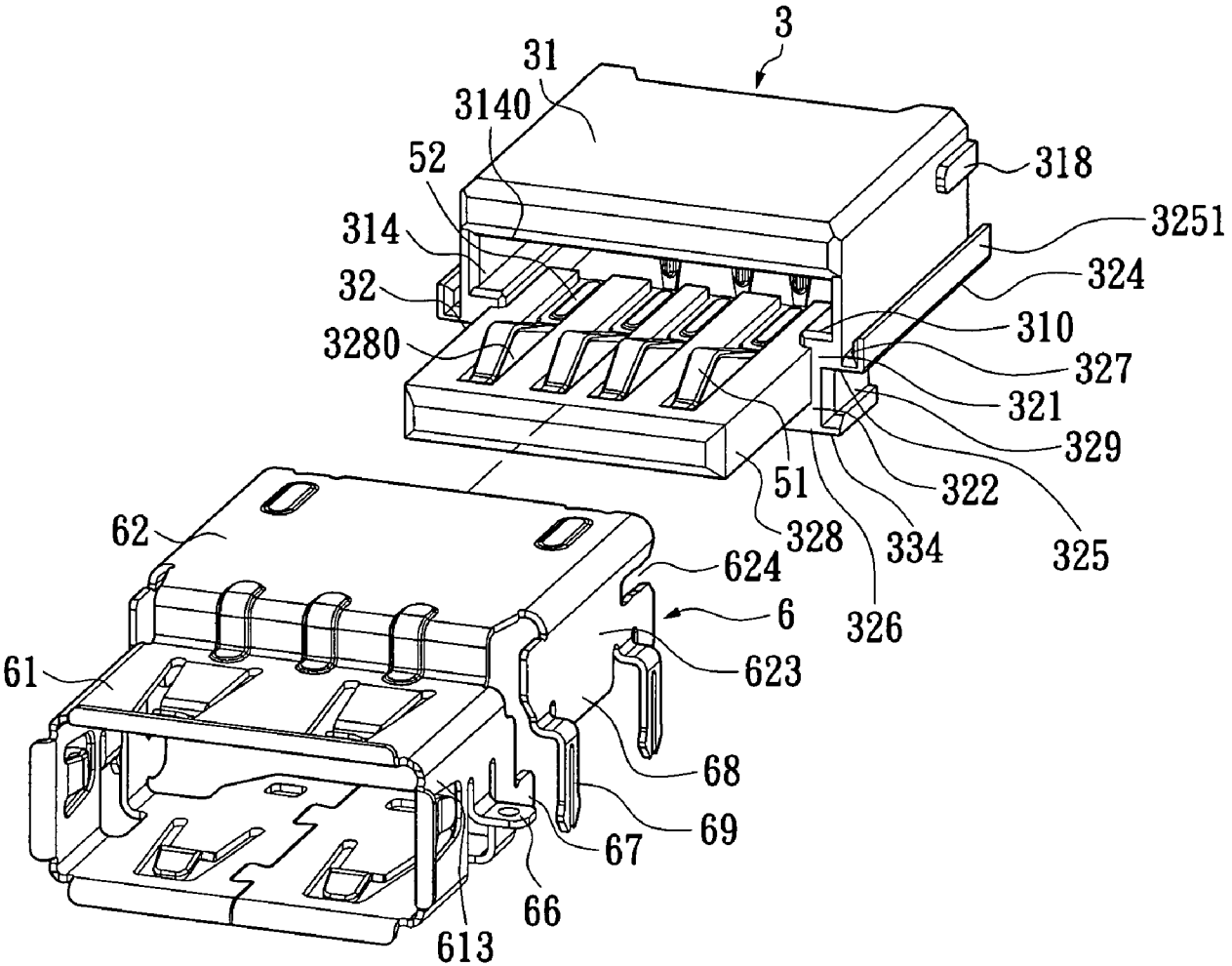
FIG. 5 is an exploded schematic view of a metal housing and the insulating body of the low-profile electrical connector according to the present invention, before assembly.
Figure 6:
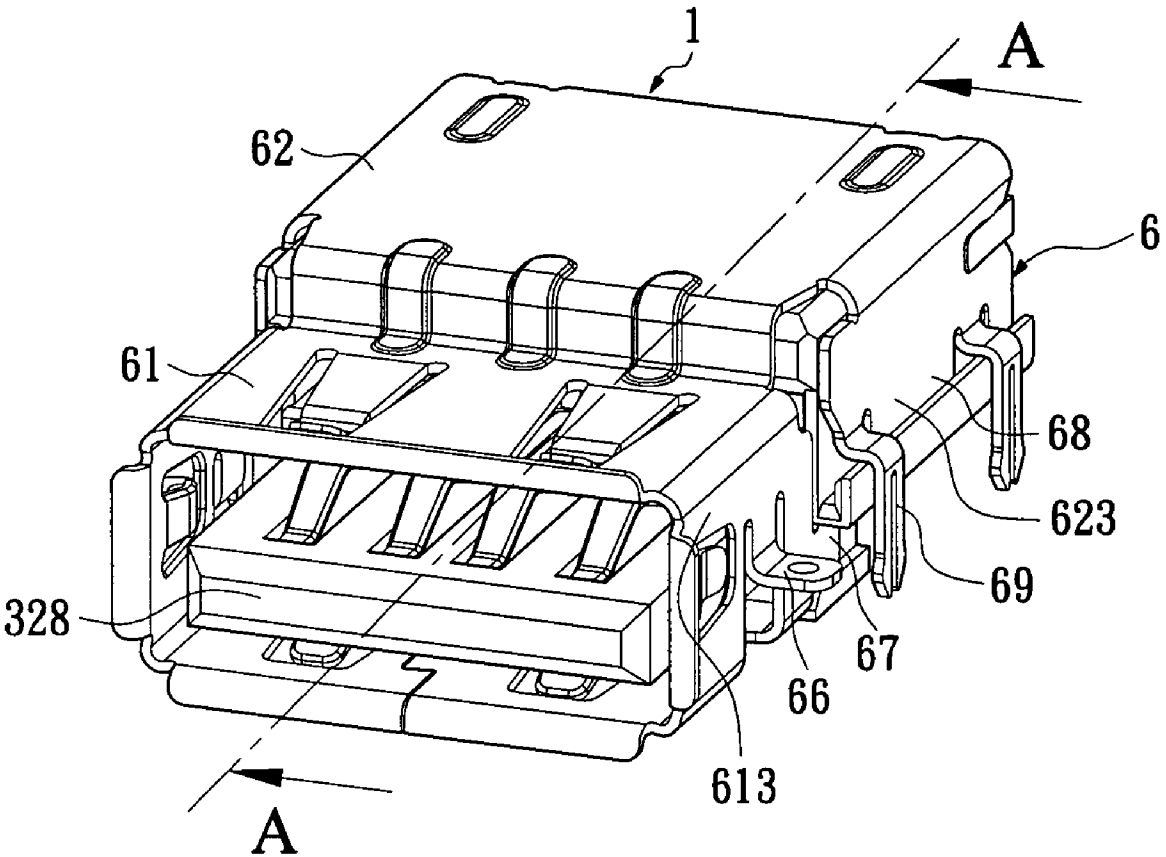
FIG. 6 is a schematic view of the metal housing and the insulating body of the low-profile electrical connector according to the present invention in FIG. 5, after assembly.
Figure 7:
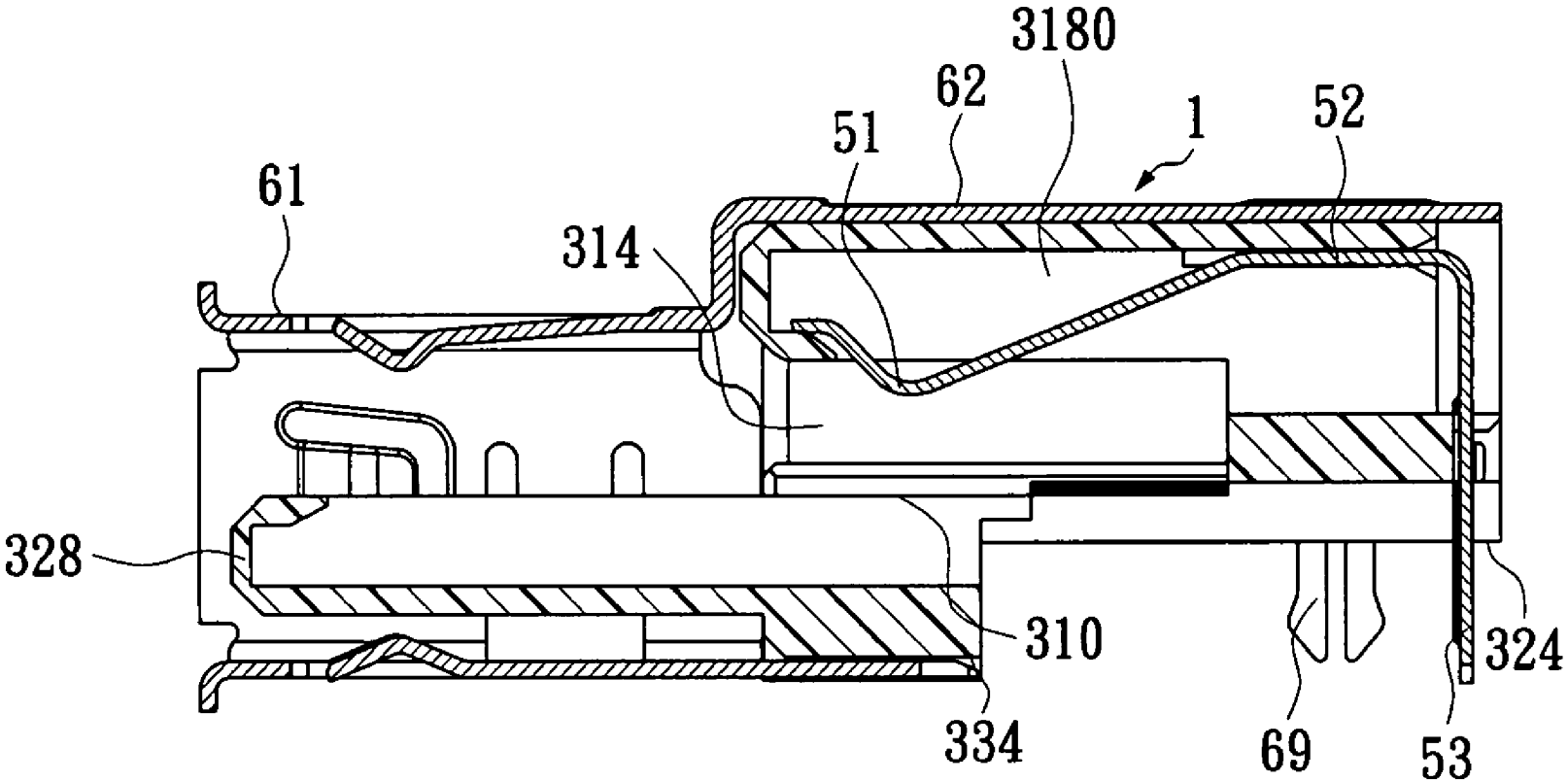
FIG. 7 is a cross-sectional view taken along lines A-A in FIG. 6.
Figure 10:
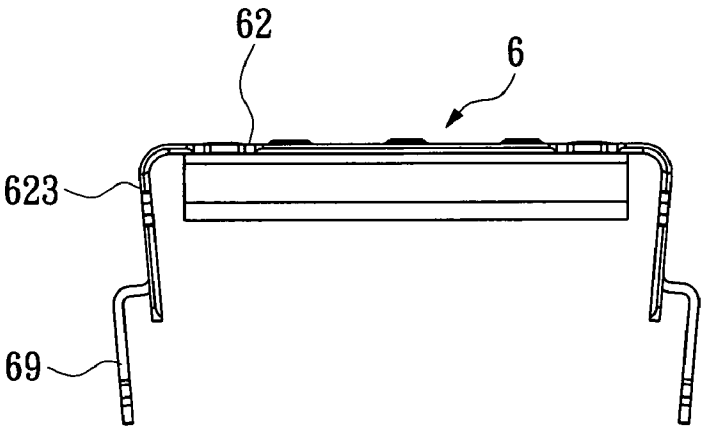
FIG. 10 is a schematic view showing that the metal housing of the low-profile electrical connector according to the present invention produces shrinkage during a stamping process.
Figure 9:
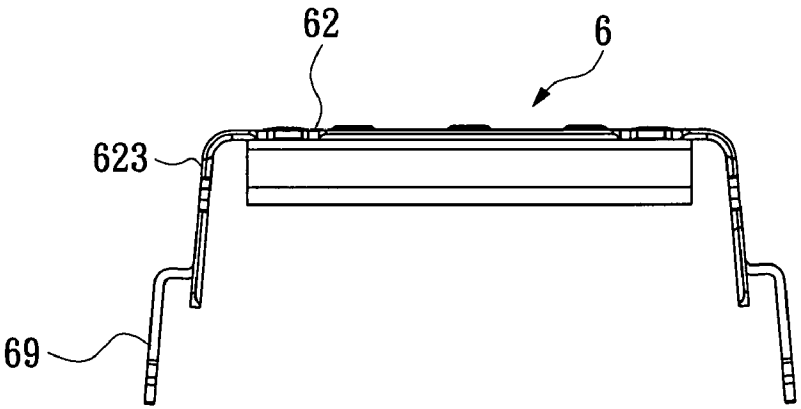
FIG. 9 is a schematic view showing that the metal housing of the low-profile electrical connector according to the present invention produces outward expansion during a stamping process.

Please refer to FIGS. 5-7, the metal housing 6 includes a front housing 61 and a rear housing 62 which are formed integrally. The front housing 61 covers the tongue plate 328 and the rear housing 62 covers the main body portion 31. Two sidewalls 613 of the front housing 61 partially turn outwards to form two welding pieces 66, respectively. Two fastening pieces 67 respectively extend rearwards from the rear end edges of the two sidewalls 613 of the front housing 61 for engaging with the fastening grooves 329 in order to prevent the front housing 61 of the metal housing 6 from turning upwards during insertion of a butting assembly (not shown) into the low-profile electrical connector 1. Two sliding portions 68 and two pins 69 respectively extend downwards from two side plates 623 of the rear housing 62, wherein the pins 69 are located on the front end edges and the rear end edges of the sliding portions 68. The sliding portions 68 engage with the sliding grooves 327 of the insulating body 3 to avoid outward expansion or inward shrinkage of the two sides of the rear housing 62 which occurs during a stamping process of the metal housing 6. FIG. 9 and FIG. 10 are schematic views showing outward expansion and inward shrinkage of the two sides of the rear housing 62, respectively. Furthermore, two locking slots 624 are concavely formed in the two rear end edges of the two sides of the rear housing 62, respectively.

Please refer to FIG. 1 simultaneously, each first conductive terminal 5 includes an elastic sheet-shaped first contacting portion 51, a first holding portion 52 extending horizontally from the first contacting portion 51 and a first welding portion 53 bent to extend vertically from the first holding portion 52. Each second conductive terminal 4 includes an elastic sheet-shaped second contacting portion 41, a second holding portion 42 extending horizontally from the second contacting portion 41 and a second welding portion 43 bent to extend vertically from the second holding portion 42.

Please refer to FIGS. 4-7, in assembly, firstly, the first conductive terminals 5 and the second conductive terminals 4 are respectively inserted into the insulating body 3 from the rear side of the insulating body 3, so that the first contacting portions 51 and the second contacting portions 41 are respectively received in a first receiving portion 3180 and the second receiving portions 3280, the first holding portions 52 and the second holding portions 42 are respectively held in the first holding grooves 3181 and the second holding grooves 3281, and the first welding portions 53 and the second welding portions 43 respectively extend out of the first bottom surface 324 of the middle portion 32 of the insulating body 3. Then, the insulating body 3 with the first conductive terminals 5 and the second conductive terminals 4 is pushed forwards into the metal housing 6 from the rear side of the metal housing 6. The sliding portions 68 of the metal housing 6 slide along the sliding grooves 327 to lead the insulating body 3 to enter the metal housing 6, till the insulating body 3 and the metal housing 6 are assembled. At this time, the sliding portions 68 are fastened in the sliding grooves 327 and the fastening pieces 67 are fastened in the fastening grooves 329. Accordingly, the low-profile electrical connector 1 is assembled.

Figure 11:
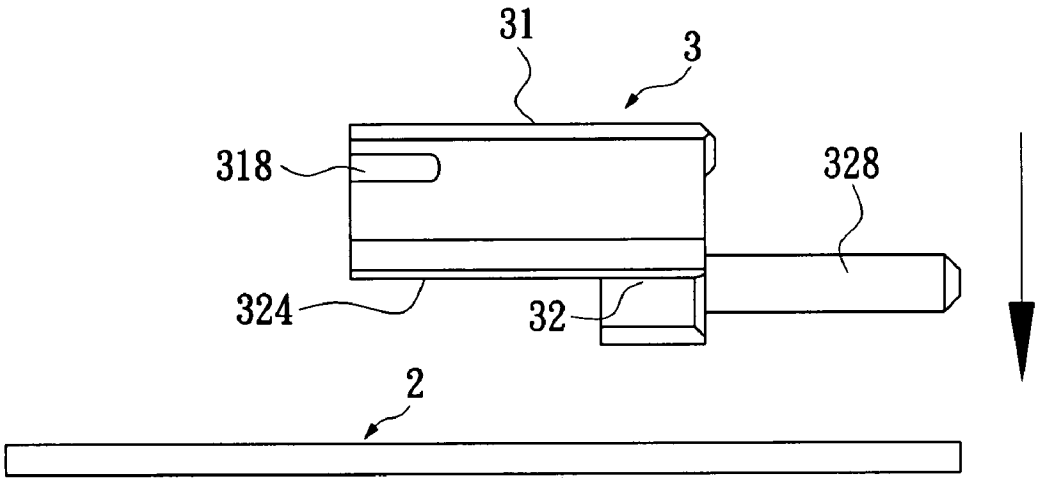
FIG. 11 is a side top view of the insulating body of the low-profile electrical connector according to the present invention and the circuit board, before assembly.
Figure 12:
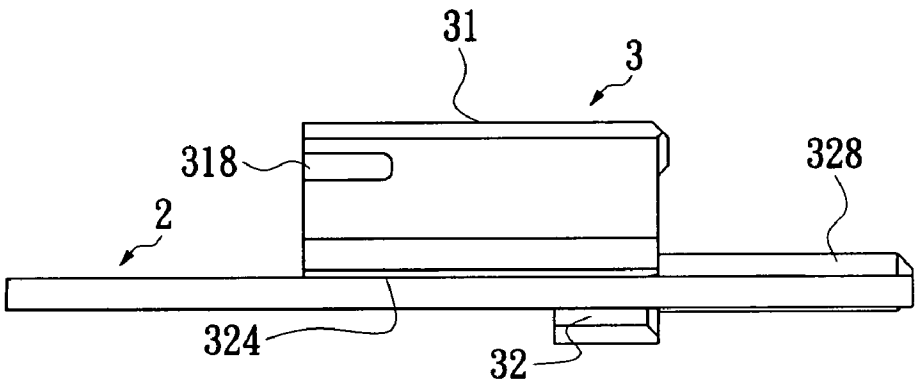
FIG. 12 is a side view of the insulating body of the low-profile electrical connector according to the present invention and the circuit board, after assembly.

Please refer to FIG. 1, FIG. 11 and FIG. 12, next, the second middle portion 326 of the low-profile electrical connector 1 is led to pass through the cutout 21 of the circuit board 2 and located below the circuit board 2, so that the first bottom surface 324 of the first middle portion 325 abuts against the circuit board 2, the first welding portions 53 of the first conductive terminals 5 and the second welding portions 43 of the second conductive terminals 4 are respectively inserted into and welded in the corresponding first terminal welding holes 23 and second terminal welding holes 22, the pins 69 are inserted into and welded in the pin holes 24 of the circuit board 2, and the welding pieces 66 of the metal housing 6 are welded on the welding pads 25 of the circuit board 2. Accordingly, the low-profile electrical connector 1 is mounted on the circuit board 2.

Consequently, the low-profile electrical connector 1 of the present invention has the advantages as follows:

1. The low-profile electrical connector 1 of the present invention, as shown in FIG. 5, has the two sliding portions 68 respectively extending downwards from the two side plates 623 of the rear housing 62 and the sliding groove 327 formed in the insulating body 3. The engagement of the sliding portions 68 and the sliding grooves 327 can not only guide the engagement of the metal housing 6 and the insulating body 3, but also avoid the outward expansion or inward shrinkage of the two sides of the rear housing 62 which occurs during the stamping process of the metal housing 6 (as shown in FIG. 9 and FIG. 10).

Figure 3:
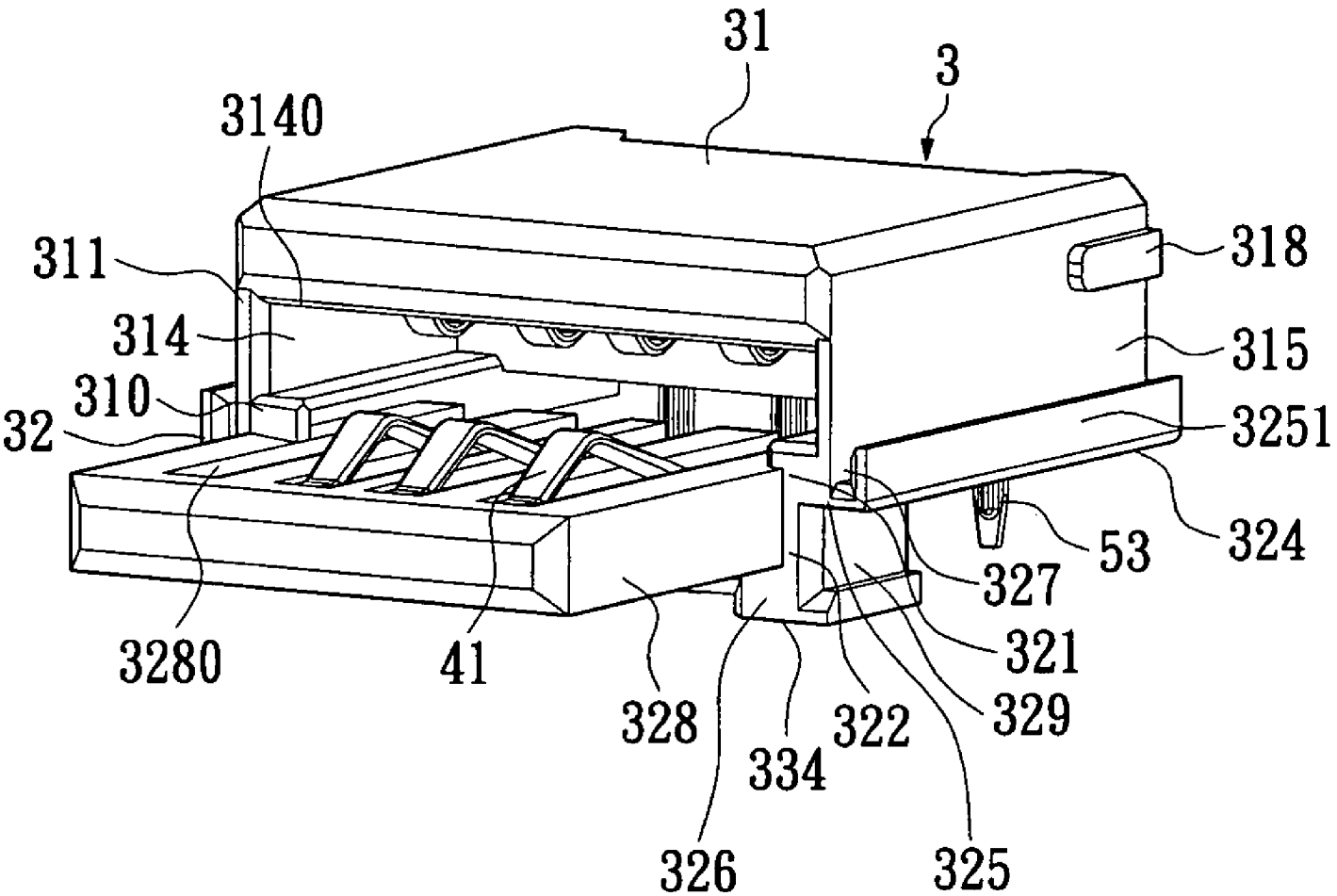
FIG. 3 is an assembled perspective schematic view of an insulating body and conductive terminals of the low-profile electrical connector according to the present invention.

2. The low-profile electrical connector 1 of the present invention, as shown in FIG. 3, has the two fool-proof units 310 which respectively extend upwards from the two sides of the lower sidewall of the slot 314 of the insulating body 3 for preventing a first butting assembly (not shown) from being inserted excessively into the low-profile electrical connector 1 and the first conductive terminals 5 from being damaged, and further avoiding insertion of a second butting assembly (not shown) into the low-profile electrical connector 1 in the opposite direction.

3. The low-profile electrical connector 1 of the present invention has the two fastening pieces 67 respectively extending rearwards from the rear end edges of the two sidewalls 613 of the front housing 61 for engaging with the fastening grooves 329, thereby preventing the front housing 61 of the metal housing 6 from turning upwards during insertion of a butting assembly (not shown) into the low-profile electrical connector 1.

What are disclosed above are only the specification and the drawings of the preferred embodiment of the present invention and it is therefore not intended that the present invention be limited to the particular embodiment disclosed. It will be understood by those skilled in the art that various equivalent changes may be made depending on the specification and the drawings of the present invention without departing from the scope of the present invention.

What is claimed is:

1. A low-profile electrical connector mounted on a circuit board, comprising:

an insulating body, the insulating body including:

a main body portion having a slot concavely formed in a front end thereof for receiving a butting assembly therein;

a middle portion formed by a downwardly extended portion of a bottom surface of the main body portion; and a tongue plate extending forwardly from the middle portion, wherein the slot has an upper sidewall facing the tongue plate and has a plurality of first terminal receiving grooves formed at intervals therein, and the tongue plate has a top surface facing the slot and has a plurality of second terminal receiving grooves formed at intervals therein; and, a plurality of conductive terminals received in the insulating body, the plurality of conductive terminals respectively received in a corresponding one of the first and second terminal receiving grooves.

2. The low-profile electrical connector as claimed in claim 1, wherein the middle portion includes a first middle portion and a second middle portion located below the first middle portion, and a rear end face of the second middle portion and a bottom surface of the first middle portion define a space.

3. The low-profile electrical connector as claimed in claim 2, wherein the circuit board is partially received in the space.

4. The low-profile electrical connector as claimed in claim 1, further comprising a metal housing disposed outside the insulating body and having a front housing and a rear housing, wherein the front housing covers the tongue plate and the rear housing covers the main body portion.

5. The low-profile electrical connector as claimed in claim 4, wherein the front housing extends rearwards to form the rear housing, and the front housing and the rear housing are formed integrally.

6. The low-profile electrical connector as claimed in claim 4, wherein the insulating body has one sliding groove formed in each of two sides thereof, the rear housing has at least one sliding portion formed on each of two sides thereof, and the sliding portions respectively correspondingly slide into the sliding grooves from front to back.

7. The low-profile electrical connector as claimed in claim 4, wherein at least one side of the main body portion has a locking block formed thereon, and at least one side of the metal housing has a locking slot formed therein.

8. A low-profile electrical connector device, comprising:

a circuit board having a cutout formed in an edge portion thereof; and a low-profile electrical connector, the connector including:

an insulating body, the insulating body including:

a main body portion having a slot concavely formed in a side thereof for receiving a butting assembly therein;

a middle portion formed by a downwardly extended portion of a bottom surface of the main body portion, the middle portion including a first middle portion and a second middle portion located below the first middle portion, wherein a rear end face of the second middle portion and a bottom surface of the first middle portion define a space for receiving edge portions of the circuit board on corresponding sides of the cutout; and a tongue plate extending forwardly from the middle portion, the tongue plate being received in the cutout; wherein the slot has an upper sidewall facing the tongue plate and has a plurality of first terminal receiving grooves formed at intervals therein, and the tongue plate has a top surface facing the slot and has a plurality of second terminal receiving grooves formed at intervals therein; and, a plurality of conductive terminals received in the insulating body, the plurality of conductive terminals respectively received in a corresponding one of the first and second terminal receiving grooves.

9. The low-profile electrical connector device as claimed in claim 8, wherein the low-profile electrical connector further includes a metal housing, and the metal housing has a front housing and a rear housing, the front housing covering the tongue plate and the rear housing covering the main body portion.

10. The low-profile electrical connector device as claimed in claim 9, wherein the front housing extends rearwards to form the rear housing, and the front housing and the rear housing are formed integrally.

11. The low-profile electrical connector device as claimed in claim 9, wherein the insulating body has one sliding groove formed in each of two sides thereof, the rear housing has at least one sliding portion formed on each of two sides thereof, and the sliding portions respectively correspondingly slide into the sliding grooves from front to back.

12. The low-profile electrical connector device as claimed in claim 9, wherein at least one side of the main body portion has a locking block formed thereon, and at least one side of the metal housing has a corresponding locking slot formed therein.

13. A low-profile electrical connector, comprising:

an insulating body, the insulating body including:

a main body portion having a slot concavely formed in a front end thereof for receiving a butting assembly and a through-groove being concavely formed in a rear end face of a bottom thereof;

a middle portion formed by a downwardly extended portion of a bottom surface of the main body portion; and a tongue plate extending forwardly from the middle portion, a top surface of the tongue plate being lower than a top surface of the through-groove, wherein the slot has an upper sidewall facing the tongue plate and has a plurality of first terminal receiving grooves formed at intervals therein, and the top surface of the tongue plate faces the slot and has a plurality of second terminal receiving grooves formed at intervals therein; and a plurality of first conductive terminals received in the insulating body, the plurality of first conductive terminals respectively received in a corresponding one of the first terminal receiving grooves; and a plurality of second conductive terminals received in the insulating body, the plurality of second conductive terminals respectively received in a corresponding one of the second terminal receiving grooves.

14. The low-profile electrical connector as claimed in claim 13, wherein the bottom surface of the main body portion and a bottom surface of the middle portion are at different heights relative to a top surface of the main body portion, and a space is defined between the bottom surface of the main body portion and the bottom surface of the middle portion.

15. The low-profile electrical connector as claimed in claim 13, wherein the through-groove is in open communication with the space.

16. The low-profile electrical connector as claimed in claim 13, wherein the through-groove is in open communication with the slot.

17. The low-profile electrical connector device as claimed in claim 13, wherein the low-profile electrical connector further includes a metal housing overlaying the insulating body, the insulating body having one sliding groove formed in each of two sides thereof, the metal housing having at least one sliding portion formed on each of two sides thereof, and each of the sliding portions being respectively received into a corresponding one of the sliding grooves.

* * * * *